United States Patent [19]

Gorsuch

[11] 4,256,467

[45] Mar. 17, 1981

[54] A FLEXIBLE ABRASIVE COATED ARTICLE AND METHOD OF MAKING IT

[76] Inventor: Ian Gorsuch, Myrtle Cottage, 48 Millbank, Headcorn, Ashford, Kent, England

[21] Appl. No.: 104,341

[22] Filed: Dec. 17, 1979

[30] Foreign Application Priority Data

Dec. 12, 1978 [GB] United Kingdom ..... 49361/78

[51] Int. Cl.[3] ..... B24D 11/02

[52] U.S. Cl. ..... 51/295; 51/309

[58] Field of Search ..... 51/295, 297, 298, 309

[56] References Cited

U.S. PATENT DOCUMENTS

| | | | |
|---|---|---|---|
| 1,966,473 | 7/1934 | Wooddell | 51/295 |
| 2,187,743 | 1/1940 | Kirchner et al. | 51/298.1 |
| 3,214,253 | 10/1965 | McCord | 51/298 |
| 3,377,264 | 4/1968 | Duke et al. | 51/295 |
| 3,517,464 | 6/1970 | Mattia et al. | 51/295 |
| 3,860,400 | 1/1975 | Prowse et al. | 51/295 |
| 4,078,906 | 3/1978 | Green | 51/295 |

FOREIGN PATENT DOCUMENTS

| | | |
|---|---|---|
| 622162 | 12/1962 | Belgium . |
| 890612 | 9/1953 | Fed. Rep. of Germany . |
| 1059794 | 9/1955 | Fed. Rep. of Germany . |
| 1375571 | 11/1974 | United Kingdom . |
| 1458236 | 12/1976 | United Kingdom . |
| 1534448 | 12/1978 | United Kingdom . |

*Primary Examiner*—Donald J. Arnold

*Attorney, Agent, or Firm*—Wheeler, House, Fuller & Hohenfeldt

[57] ABSTRACT

A flexible abrasive member is formed by applying a layer of metal (13;15,16) to mesh material (12). Abrasive material (14) is embedded in the metal layer during the deposition of the layer by an electrodeposition process. The mesh material may be electrically non-conducting woven material and the metal layer is deposited through the mesh material.

In making the member the mesh material is laid on a smooth, preferably curvilinear, surface (10) formed with areas (11) for receiving the metal layer. Abrasive material is introduced onto the surface at the beginning of the metal deposition process or towards the end of the deposition process.

11 Claims, 4 Drawing Figures

A FLEXIBLE ABRASIVE COATED ARTICLE AND METHOD OF MAKING IT

Figure 1:
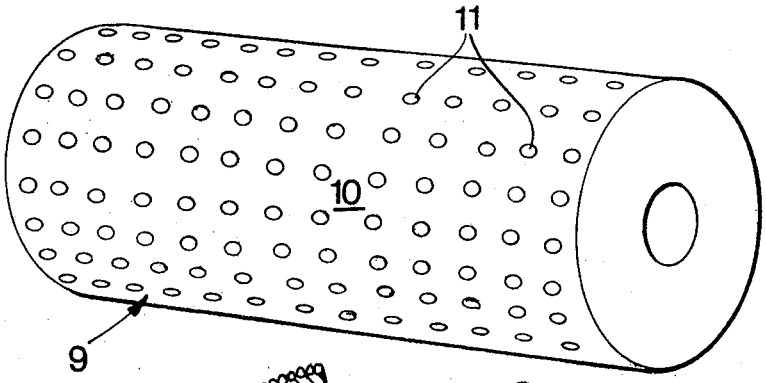

This invention relates to abrasive members and in particular to flexible abrasive members incorporating abrasive particles. The invention will find particular application in grinding, smoothing and performing other operations on glass or other materials.

The abrasive member is primarily intended for use in grinding lenses of both male and female curvature, toric or plain and in glass or plastics material.

Disposable abrasive pads have already been proposed for lens grinding in order to obviate the use of abrasive slurry but such pads have had a short life and/or they have been insufficiently flexible to conform accurately to the curvature of the cast iron laps to which they are applied.

There has also been proposed in British Pat. Nos. 1,375,571 and 1,458,236 abrasive members including mesh material, the abrasive being located only over discrete areas of the member. However, such members utilise mesh of electrically-conducting material or metal objects on which the abrasive is directly deposited and a backing material is also required.

An object of the invention is to provide a long life abrasive member capable of acting as an interface lens pad and sufficiently flexible to conform accurately to the shape and curvature of an optical lap.

According to the invention a flexible abrasive member is characterized by being formed of non-electrically conductive flexible material or flexible material having a non-electrically conducting coating, the material being formed with a layer of metal in which abrasive material is embedded, and the layer of metal adhering to the mesh material.

Preferably the layer of metal is formed by an electrodeposition process. The layer of metal may be formed on selected discrete areas of the mesh material.

Conveniently the abrasive material is located only to one side of the mesh material and lies on the surface of the metal layer at said one side of the mesh material.

Alternatively, the abrasive particles are randomly orientated in the metal.

The invention also provides a method of making a flexible abrasive member characterised by laying a length of flexible mesh material having non-electrically conducting properties or having a non-electrically conductive coating onto a smooth electrically-conductive surface and depositing a layer of metal onto the surface and thereby onto the mesh material in the presence of abrasive material which thereby becomes embedded in the metal.

Preferably the smooth surface is of curvilinear form and the mesh material is applied under tension to the surface. The surface may be applied with electrically insulating material over selected areas of the surface so that the metal is deposited only over remaining discrete areas of the surface.

Conveniently the smooth surface is cylindrical and formed of stainless steel treated over said remaining areas to prevent adhesion of the metal layer to the surface.

In one arrangement the abrasive material is present on the smooth surface at the commencement of deposition of metal on said surface whereby the operative surfaces of the member have abrasive particles lying in a common plane.

Alternatively a metal layer is deposited on the smooth surface in the absence of abrasive material and a further layer of metal is deposited on the first layer in the presence of abrasive material to embed the abrasive material in the further layer.

Figure 2:
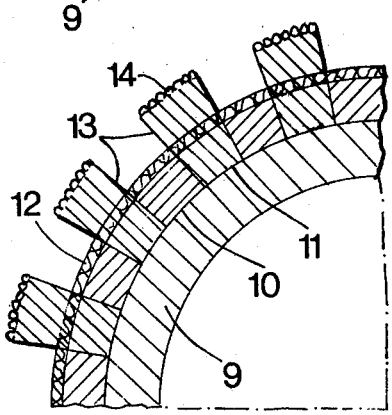
Figure 3:
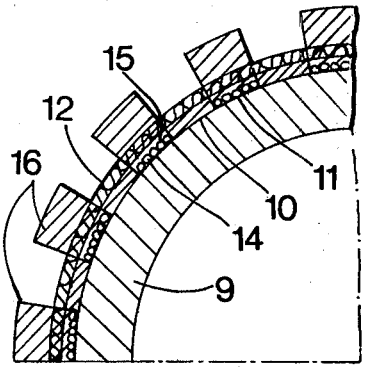
Figure 4:
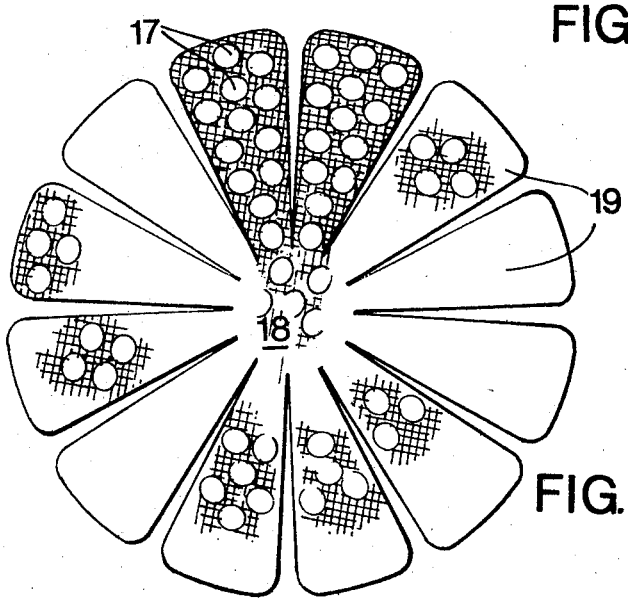

Further features of the invention will appear from the following description of various embodiments and methods of the invention given by way of example only and with reference to the drawings, in which:

FIG. 1 is a perspective view of a cylinder on which abrasive members are made, FIG. 2 is a cross-section showing, on an exaggerated scale, one form of abrasive member formed on the cylinder of FIG. 1, FIG. 3 is a view similar to FIG. 2 of another form of abrasive member, and FIG. 4 is a plan view of one form of abrasive member.

In FIG. 1 is shown a cylinder 9 which is formed of stainless steel or other electrically conductive metal having a smooth cylindrical surface 10. The surface 10 is coated with an electrically insulating acid resist except for discrete spaced, in this case circular, areas 11 arranged in the desired pattern of abrasive material on the abrasive member or pad to be formed according to the particular application of the pad. The surfaces of the areas 11 are treated in known manner to prevent the adhesion of metal which is electro-plated onto the areas 11.

In forming an abrasive pad a length of flexible mesh 12, which may be formed of nylon, terylene or similar electrically non-conducting woven material, is stretched tightly around the cylinder 9. The cylinder is then immersed in an electrolyte bath of known form containing a metal electrolyte of any metal capable of being electroplated or electroless plated, but usually nickel or copper.

In one method, described with reference to FIG. 2, metal 13 is deposited electrolytically over the circular areas 11 of the cylinder thereby being deposited onto the mesh 12 and through the mesh onto the cylinder so that the mesh is embedded in the metal. A thickness of metal 13 is deposited until almost the full eventual, desired thickness is reached. Abrasive particles 14 in the form of diamond, cubic boron nitride or other suitable abrasive material, are then introduced into the electrolyte bath in suspension whereupon such material becomes deposited on the metal. Deposition of metal then continues until the particles 14 are embedded in the outer layer of the metal and lie at the surface of the metal and the cylinder is then removed from the bath.

The cylinder, now having a covering of mesh, metal and abrasive particles, is rinsed and the mesh is stripped from the cylinder. In this form a length of abrasive material is produced in which one side of the material has discrete areas presenting randomly orientated abrasive particles suitable for relatively rough grinding operations, for example, stock removal. The material may be in a finished form ready for use or it may be trimmed in other shapes such as that shown in FIG. 4.

In another method, described with reference to FIG. 3, the same cylinder 9 may be used, again with a pattern of insulating material formed on its surface to prevent deposition of metal except over selected areas 11. The cylinder is immersed in electrolyte solution and deposition of metal over the exposed surfaces of the cylinder is commenced. Abrasive particles 14 present in the electrolyte solution simultaneously settle onto the exposed surfaces so that during deposition the particles on the areas 11 become embedded in a thin layer of metal, as at 15 in FIG. 3.

When sufficient abrasive particles 14 are embedded in the initial metal layer 15 the cylinder 9 is removed from the solution and the cylinder is washed and dried. A length of mesh 12 is wound tightly around the cylinder having its layer of metal and abrasive particles in place. The cylinder is replaced in the electrolyte solution and electroplating is recommenced this time laying down a layer of metal 16 only, onto and through the mesh 12 and onto the previously-formed layer 15 to form an integral layer 15,16. On completion of the layer 16 of metal, when it has reached its desired thickness, the cylinder 9 is removed and rinsed and the mesh 12 embedded in the layers 15 and 16 is stripped from the cylinder.

In the latter case the operative points of the abrasive particles 14 are on one surface of the material and all lie on the same plane, flush with said surface which was the surface in contact with the smooth surface of the cylinder 9. This form of abrasive material is suitable for producing a finely ground surface, for example for grinding lenses prior to polishing, because the operative portions of the abrasive particles are all at the same effective level in relation to the surface to be ground.

As before, the material of FIG. 3 may be ready for use or may be trimmed to provide a pad such as shown in FIG. 4 which is a generally circular pad having a central area 18 extending outwards from which are part segmental portions 19 separated circumferentially from one another. The operative portions carrying abrasive material are circular as at 17 and the portions 17 correspond to the areas 11 in FIG. 1. The pad constitutes a flexible abrasive member in which the portions 17 are closely spaced from one another.

In each case the mesh material used is electrically insulating or has an electrically insulating coating. Thus, in addition to woven fibre cloth or fabric, the mesh may be of copper, brass or steel coated with insulating material.

Instead of forming the areas of the cylinder to be coated with metal by using an acid resist, a photo resist process, of known form, may be used. Alternatively a silk screening process may be used to form a patterned coating of insulating material. As a still further alternative the area to be coated may be defined by an insulating stencil adhered to the surface.

Instead of a cyliner a curved member may be employed on which the mesh material may be tightly held to ensure intimate contact with the surface of the member. Such contact may be achieved with adhesive to hold the mesh against the surface. Alternatively, provided the cloth is held against the smooth surface, such receiving surface may be flat.

When using a cylinder of the kind shown in FIG. 1 the axis of the cylinder will usually be horizontal during electro-deposition and, in some cases, the cylinder is rotated during deposition of abrasive particles although this is not always necessary, especially when the particles are in suspension in the electrolyte.

It will be appreciated that this invention provides an abrasive member with considerable flexibility and able to conform to the curvature of a lap without inaccuracies in curvature being produced. Thus in lens grinding the member is able to work to male or female curvatures, plain or toric lenses, and on glass or plastics materials. The invention may also find application in other grinding and smoothing operations.

I claim:

1. A method of making a flexible abrasive member in which a length of flexible, non-electrically conducting mesh material is laid onto a smooth electrically-conductive surface, a layer of metal is electro-deposited onto said smooth surface and thereby directly onto and through the mesh material in the presence of abrasive material so that the abrasive material becomes embedded in the metal layer and the metal layer is adhered to the mesh, and the mesh and the associated metal layer with embedded abrasive material is stripped from the electrically conductive surface to constitute the abrasive member.

2. A method according to claim 1 wherein the smooth surface is applied with electrically insulating material over selected areas of the surface so that the metal layer is deposited only over remaining discrete areas of the surface and corresponding discrete areas of the mesh.

3. A method according to claim 1 wherein the smooth surface is of curvilinear form and the mesh material is applied under tension to the surface.

4. A method according to claim 3 wherein the smooth surface is cylindrical and of stainless steel treated over said remaining areas to prevent adhesion of the metal layer to the surface.

5. A method according to claim 1 wherein abrasive material is present on the smooth surface at the commencement of deposition of metal on said surface.

6. A method according to claim 1 wherein a metal layer is deposited on the smooth surface in the absence of abrasive material and a further layer of metal is deposited on the first layer in the presence of abrasive material to embed the abrasive material in the further layer.

7. A method according to claim 1 wherein the mesh material is formed of woven fabric.

8. A flexible abrasive member comprising a flexible non-electrically conductive mesh material, a layer of electro-deposited metal adhered directly to and extending through the mesh material so that the mesh material is embedded in the metal layer, the layer of metal having abrasive material embedded therein.

9. An abrasive member according to claim 8 wherein the layer of metal is formed on selected discrete areas of the mesh material.

10. An abrasive member according to claim 8 wherein the abrasive material is located to one side of the mesh material and lies on the surface of the metal layer at said one side of the mesh material.

11. An abrasive member according to claim 8 wherein the mesh material is of woven fabric.

* * * * *